US009373454B2

(12) United States Patent
Takemae et al.

(10) Patent No.: US 9,373,454 B2
(45) Date of Patent: Jun. 21, 2016

(54) KEY SWITCH AND KEYBOARD

(71) Applicant: Fujitsu Component Limited, Tokyo (JP)

(72) Inventors: Akihiko Takemae, Tokyo (JP); Tamotsu Koike, Tokyo (JP); Takeshi Nishino, Tokyo (JP); Hiroki Satou, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 41 days.

(21) Appl. No.: 14/261,600

(22) Filed: Apr. 25, 2014

(65) Prior Publication Data

US 2014/0318942 A1 Oct. 30, 2014

(30) Foreign Application Priority Data

Apr. 26, 2013 (JP) ..... 2013-094496

(51) Int. Cl.
*H01H 13/70* (2006.01)
*H01H 3/12* (2006.01)
*H01H 13/7065* (2006.01)

(52) U.S. Cl.
CPC ..... *H01H 3/125* (2013.01); *H01H 13/7065* (2013.01); *H01H 2221/058* (2013.01)

(58) Field of Classification Search
CPC ..... H01H 3/12; H01H 3/122; H01H 3/125; H01H 13/14
USPC ..... 200/5 A, 341, 344, 345, 516, 520
See application file for complete search history.

(56) References Cited

U.S. PATENT DOCUMENTS

| | | | | |
|---|---|---|---|---|
| 6,179,497 | B1 * | 1/2001 | Hu | 400/495 |
| 6,726,093 | B2 * | 4/2004 | Hsu et al. | 235/375 |
| 8,207,465 | B2 * | 6/2012 | Maruyama et al. | 200/344 |
| 8,624,140 | B2 * | 1/2014 | Nishino et al. | 200/302.2 |
| 8,816,231 | B2 * | 8/2014 | Shen | 200/516 |
| 8,957,332 | B2 * | 2/2015 | Yamada | 200/5 A |
| 2010/0025213 | A1 * | 2/2010 | Li | 200/344 |

FOREIGN PATENT DOCUMENTS

| | | |
|---|---|---|
| JP | 2013-41765 | 2/2013 |

* cited by examiner

*Primary Examiner* — Vanessa Girardi
(74) *Attorney, Agent, or Firm* — Staas & Halsey LLP

(57) ABSTRACT

Provided is a key switch that enables sufficiently enhancement of the rigidity of a key top. A key switch includes a support plate; a key top disposed on the support plate; a link configured to link the key top with the support plate; a switch; a first arm disposed on a back surface of the key top between the link and a first short-side end of the key top, and extending in a long-side direction of the key top; a second arm disposed on the back surface of the key top between the link and a second short-side end of the key top, and extending in the long-side direction of the key top; and a reinforcement plate mounted on the key top. The reinforcement plate comprises a short-side part extending in the short-side direction of the key top between the first arm and the second arm.

10 Claims, 12 Drawing Sheets

KEY SWITCH AND KEYBOARD

BACKGROUND OF THE INVENTION

1. Field of the Invention

The present invention relates to a key switch, and a keyboard provided with the key switch.

2. Description of the Related Art

In the field of keyboards for use in a personal computer (PC), for instance, there is a demand for decreasing the thickness of a keyboard along with a demand for decreasing the thickness of a PC. In order to decrease the thickness of a keyboard, a measure for decreasing the thickness of a key top has been adopted in the conventional art. However, the rigidity of the key top may be reduced by decreasing the thickness of a key top, and when the key top is stroked, the key top is likely to be deformed. For instance, Japanese Laid-open Patent Publication 2013-41765 discloses a configuration, in which an arm bar for reinforcement is mounted on a key top in order to enhance the rigidity of the key top and to prevent deformation of the key top.

As the conventional art has failed to sufficiently enhance the overall rigidity of a key top, when a load is applied to an end of a key top, it is difficult to sufficiently suppress deformation of the key top. For instance, when a user strokes one of the four corners of a key top, the key top may be deformed. When a key top is deformed, it is difficult to accurately operate a key switch configured to open and close in accordance with an up-down operation of the key top.

In view of the above, an object of the invention is to provide a key switch that enhances the rigidity of a key top. Another object of the invention is to provide a keyboard provided with a key switch that enhances the rigidity of a key top.

SUMMARY OF THE INVENTION

According to an aspect of the invention, a key switch includes a support plate; a key top disposed on the support plate; a link configured to link the support plate with the key top; a switch; a first arm disposed on a back surface of the key top between the link and a first short-side end of the key top, and extending in a long-side direction of the key top; a second arm disposed on the back surface of the key top between the link and a second short-side end of the key top, and extending in the long-side direction of the key top; and a reinforcement plate mounted on the key top. In the configuration, the reinforcement plate includes a short-side part extending in the short-side direction of the key top between the first arm and the second arm.

BRIEF DESCRIPTION OF THE DRAWINGS

The aforementioned or other objects, features, and advantages of the present invention will become more apparent based on the following embodiments with reference to the accompanying drawings in which.

DESCRIPTION OF EMBODIMENTS

Figure 1:
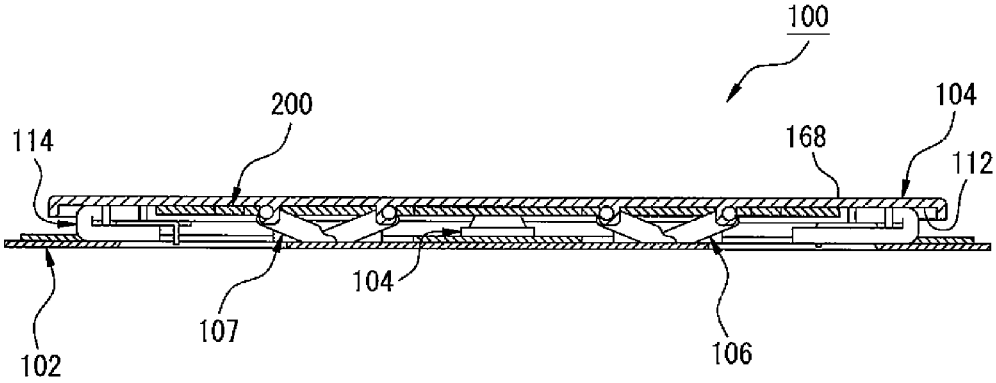
FIG. 1 is a side sectional view of a key switch according to an embodiment of the invention.
Figure 2:
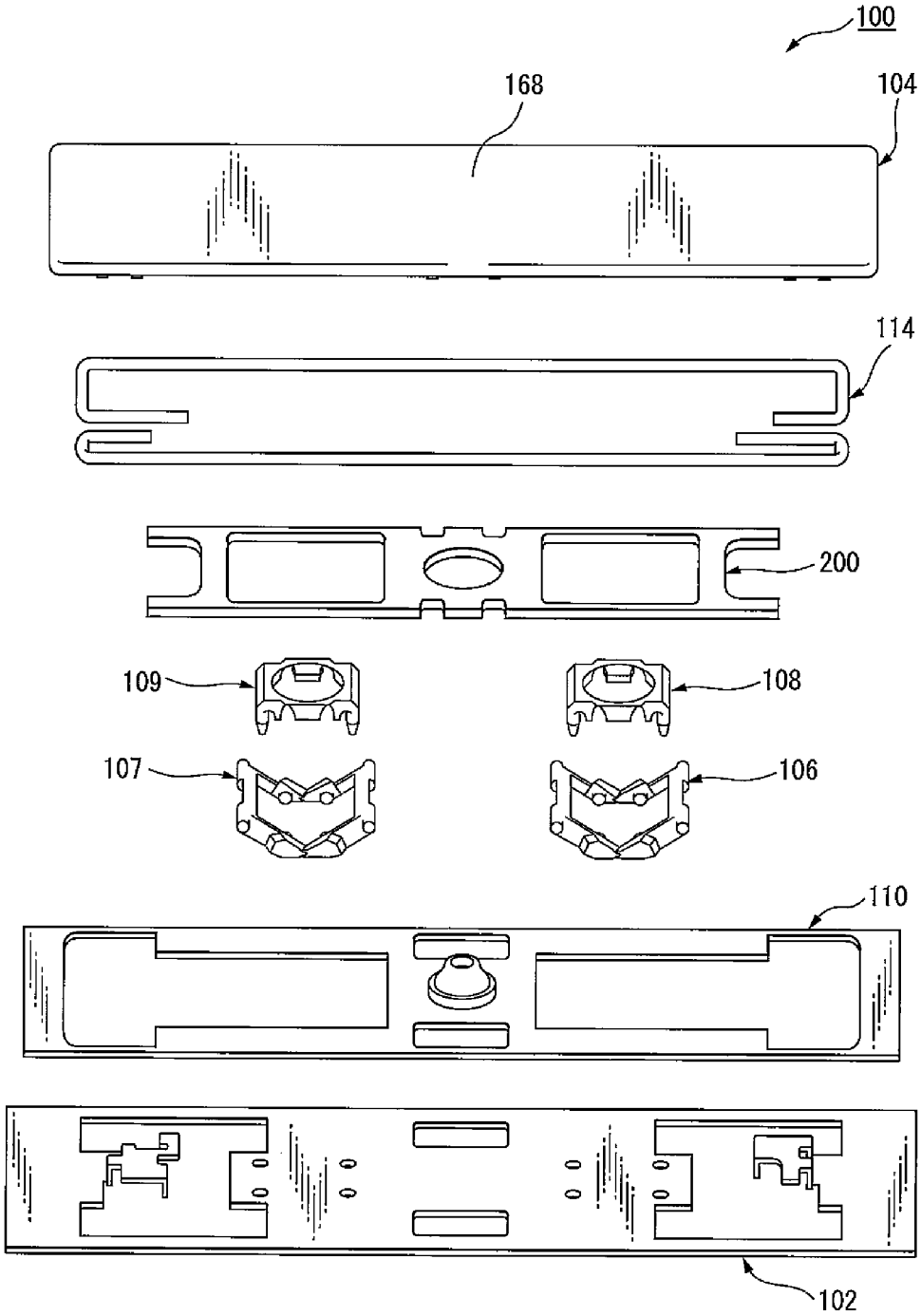
FIG. 2 is an exploded perspective view of the key switch illustrated in FIG. 1.

In the following, embodiments of the invention are described in detail based on the drawings. Referring to FIGS. 1 and 2, a schematic configuration of a key switch 100 according to an embodiment of the invention is described. Note that the front-rear direction, the left-right direction, and the up-down direction in the following description are based on directions illustrated in FIGS. 1 and 2. The front-rear direction indicates the short direction of a key top 104. The left-right direction indicates the longitudinal direction of the key top 104, and the up-down direction indicates the thickness direction of the key top 104.

Further, the front direction indicates a direction toward the upside of FIG. 2 along the short direction of a key top 104 (i.e., a direction toward the back of FIG. 1 which is a side sectional view seen from rear-side), the right direction indicates the right direction of FIG. 1, and the upper direction indicates the upper direction of FIG. 1. The exploded perspective view of FIG. 2 is a diagram illustrating a group of constituent elements of the key switch 100 illustrated in FIG. 1, as viewed from the rear upper side.

The key switch 100 according to the embodiment is a device aligned in a plural number and loaded on a keyboard (not illustrated) stroked by a user for operating an electronic device such as a PC.

The key switch 100 is provided with a support plate 102 fixed on a main body of a keyboard, and a key top 104 disposed above the support plate 102. A first link 106 and a second link 107 for guiding the up and down movement of the key top 104 are disposed between the support plate 102 and the key top 104. As illustrated in FIG. 2, the first link 106 is disposed in the right region of the key top 104, and the second link 107 is disposed in the left region of the key top 104.

The key switch 100 is provided with a first frame 108 for fixing the first link 106 on the support plate 102, and a second frame 109 for fixing the second link 107 on the support plate 102. The key switch 100 is provided with a switch 110 disposed above the support plate 102, wires 114 supported between the support plate 102 and a back surface 112 of the key top 104, and a reinforcement plate 200 mounted on the back surface 112 of the key top 104.

In the following, each of the elements of the key switch 100 is described in detail. First of all, a configuration of the support plate 102 is described referring to FIG. 3. The support plate 102 is provided with a base 116, a first wire receiving part 118 and a second wire receiving part 120 formed in such a manner as to protrude upward from the base 116, and through holes 122 and 123 formed in the base 116.

The support plate 102 is made of a metal. The base 116 is a flat plate member having a predetermined thickness. The first wire receiving part 118 is formed in the right region in FIG. 3, and includes cutaways 124 and 126 with an opening to the right direction.

Figure 3:
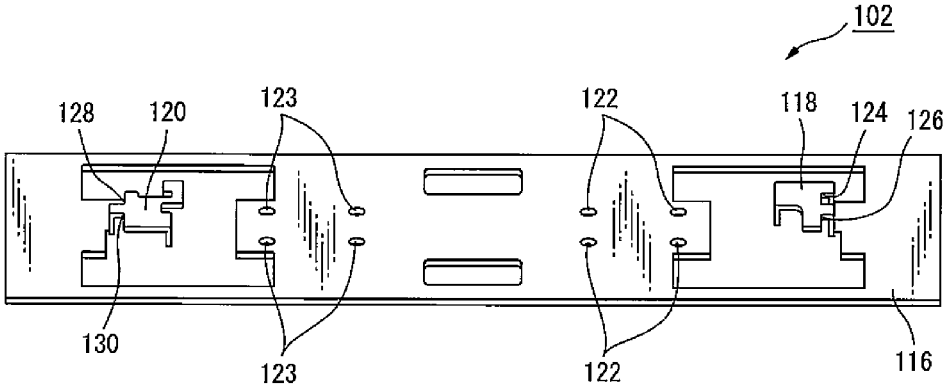
FIG. 3 is a perspective view of a support plate illustrated in FIG. 2.

Likewise, the second wire receiving part 120 is formed in the left region in FIG. 3, and includes cutaways 128 and 130 with an opening to the left direction. Four through holes 122 are formed at positions corresponding to four corners of a rectangular region in the right region in FIG. 3. The four through holes 122 are disposed on the left side of the first wire receiving part 118. Likewise, four through holes 123 are formed at positions corresponding to four corners of a rectangular region in the left region of the base 116. The four through holes 123 are disposed on the right side of the second wire receiving part 120.

Figure 4:
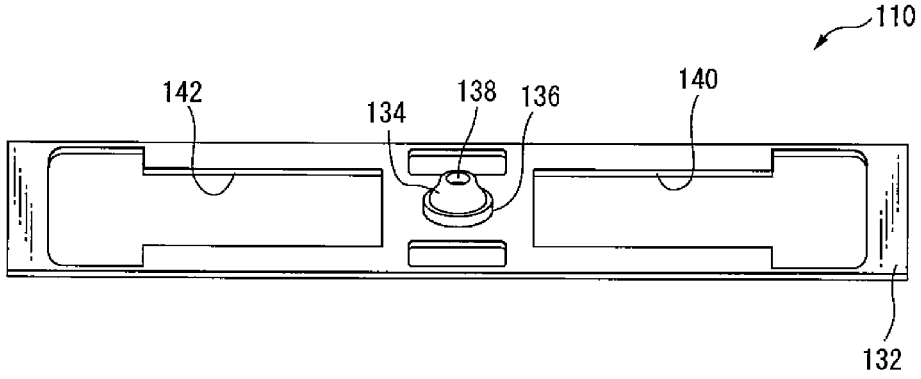
FIG. 4 is a perspective view of a switch illustrated in FIG. 2.

Next, a configuration of the switch 110 is described referring to FIG. 4. The switch 110 includes a sheet 132, an urging part 134 protruding upward from the upper surface of the sheet 132, and a contact (not illustrated) formed on the sheet 132 within the urging part 134.

A substantially T-shaped punched part 140 is provided in the right region of the sheet 132. Further, a punched part 142 disposed to be reflectionally symmetrical with respect to the punched part 140 is provided in the left region of the sheet 132.

The punched part 140 is formed at a position corresponding to the first link 106, the frame 108 and the first wire receiving part 118 of the support plate 102. Further, the punched part 142 is formed at a position corresponding to the second link 107, the frame 109 and the second wire receiving part 120 of the support plate 102.

The urging part 134 is made of an elastic material such as a rubber. The urging part 134 has a dome shape, and extends from a circular base 136 fixed on the sheet 132 to an apex 138 while gradually reducing the diameter as the urging part 134 extends upward. The apex 138 comes into contact with the back surface 112 of the key top 104 in a state that the key switch 100 is assembled as shown in FIG. 1. A protrusion (not illustrated) is formed on the inner surface of the apex 138 at a position corresponding to the contact on the sheet 132.

When a force is not applied to the key top 104, the urging part 134 supports the key top 104 at a predetermined stroke upper limit position. When the key top 104 is pressed by the user, the urging part 134 is elastically deformed in buckling manner, and applies an upward urging force to the key top 104.

When the key top 104 reaches the stroke lower limit position, the protrusion formed on the inner surface of the apex 138 presses the contact, and the contact is closed. When the force applied to the key top 104 is released, the urging part 134 is elastically recovered to return the key top 104 to the stroke upper limit position. Then, the contact is released.

Figure 5:
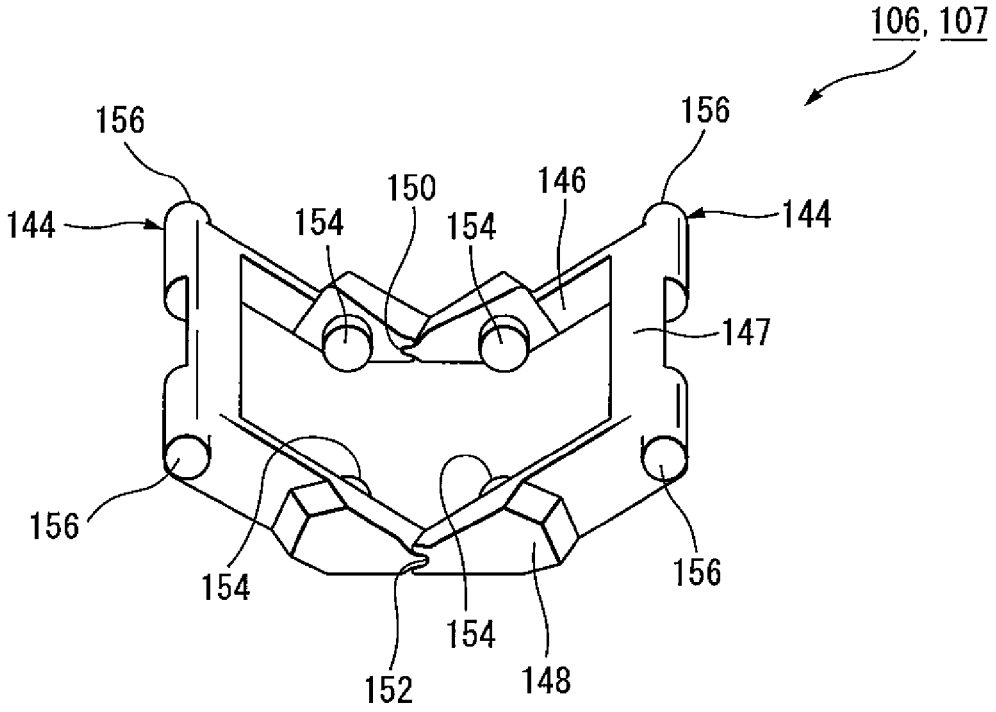
FIG. 5 is a perspective view of a link illustrated in FIG. 2.

Next, a configuration of the first link 106 and the second link 107 is described referring to FIG. 5. The first link 106 and the second link 107 according to the embodiment have the same configuration as each other. In the following description, a configuration of the first link 106 is described in detail, and a description of the second link 107 is omitted.

The first link 106 includes a pair of link members 144. The two link members 144 in the embodiment have the same shape and the size as each other. The link member 144 includes a pair of arms 146 and 148 extending in parallel to each other, and a connection part 147 for connecting the arms 146 and 148 to each other.

A convex part 150 is formed at a tip of the arm 146. On the other hand, a concave part 152 is formed in a tip of the arm 148. Further, the arms 146 and 148 include pins 154 protruding toward each other. The connection part 147 includes outwardly protruding pins 156 at both ends of the connection part 147.

As illustrated in FIG. 5, the first link 106 is configured by disposing the two link members 144 to face each other, while fitting the convex part 150 of one of the link members 144 in the concave part 152 of the other of the link members 144. According to the configuration, the link members 144 linked to each other are allowed to pivotally move relative to each other around a fitting part between the convex part 150 and the concave part 152. In this way, the first link 106 and the second link 107 function as a V-shaped gear link.

Figure 6:
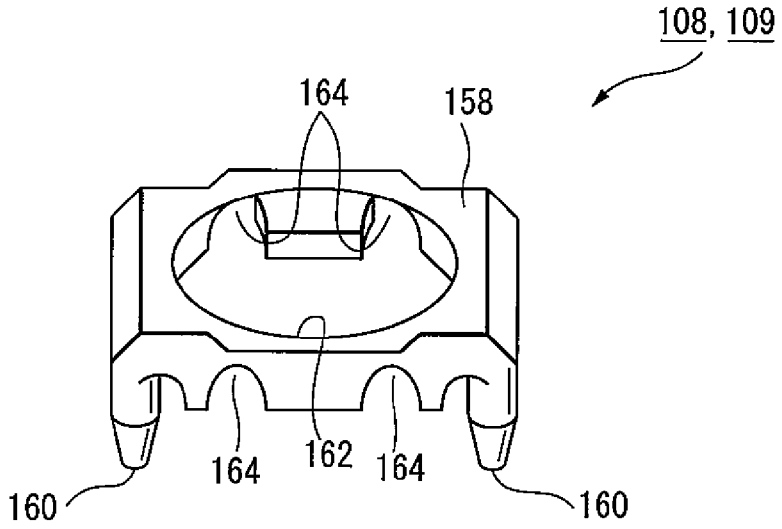
FIG. 6 is a perspective view of a frame illustrated in FIG. 2.

Next, the first frame 108 and the second frame 109 are described referring to FIG. 6. The first frame 108 and the second frame 109 according to the embodiment have the same configuration as each other. In the following, a configuration of the first frame 108 is described in detail, and a description of the second frame 109 is omitted.

The first frame 108 includes a frame 158 of a substantially rectangular shape in top plan view, and four legs 160 protruding downward from four corners of the frame 158. In FIG. 6, only two legs out of the four legs 160 are illustrated. A through hole 162 is formed in the center of the frame 158. Further, downwardly opened four holes 164 are formed in lower ends of a front wall and a rear wall of the frame 158.

Figure 7A:
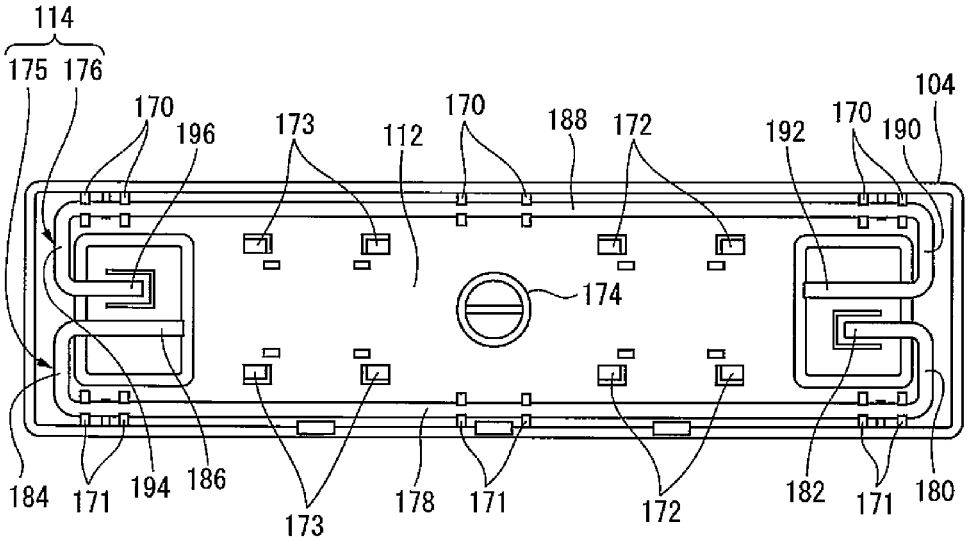
FIGS. 7A and 7B are assembly diagrams of a key top and wires illustrated in FIG. 2.
Figure 7B:
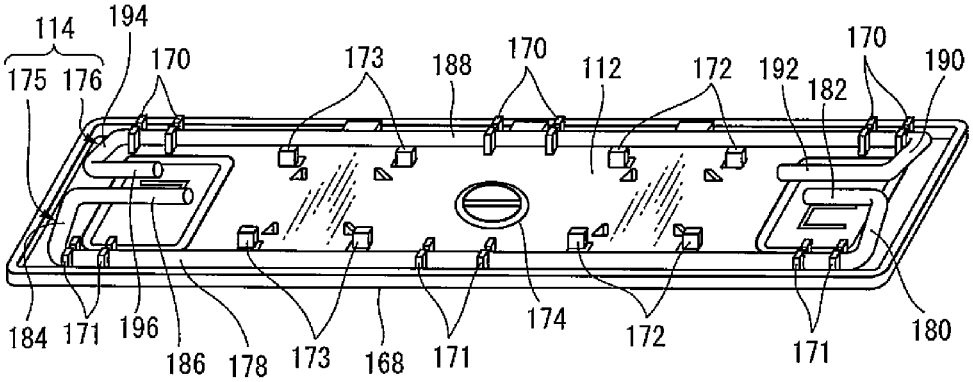

Next, a configuration of the wires 114 and the key top 104 is described referring to FIGS. 7A and 7B. FIG. 7A is a bottom plan view of an assembly of the key top 104 and the wires 114 as viewed from below, and FIG. 7B is a perspective view of the assembly of the key top 104 and the wires 114 as viewed from the lower front side. Note that, in FIG. 7A, the front direction corresponds to a direction toward the downside of FIG. 7A, the right direction corresponds to the right direction of FIG. 7A.

The key top 104 is a substantially rectangular member, and includes an operation surface 168 (FIG. 2) to be stroked by the user, and the back surface 112 on the opposite side of the operation surface 168. Plural claws 170 protruding from the back surface 112 are formed on one end (the upper end in FIG. 7A) of the back surface 112. Each of the claws 170 includes a pair of protrusions disposed to be separated from each other in the short-side direction of the key top 104. Six claws 170 are formed to align in the long-side direction.

Further, plural claws 171 protruding from the back surface 112 are formed on the other end (the lower end of FIG. 7A) of the back surface 112. Similar to the claws 170, each of the claws 171 includes a pair of protrusions disposed to be separated from each other in the short-side direction of the key top 104. Six claws 171 are formed to align in the long-side direction.

Four guides 172 protruding from the back surface 112 are formed in the right region of the back surface 112. The guides 172 are formed at positions corresponding to four corners of a substantially square region. Likewise, four guides 173 protruding from the back surface 112 are formed at positions corresponding to four corners of a substantially square region in the left region of the back surface 112.

A groove extending in the long-side direction of the key top 104 is formed in each of the guides 172. The pins 156 of the first link member 106 are slidably received inside the grooves. Likewise, a groove extending in the long-side direction of the key top 104 is formed in each of the guides 173. The pins 156 of the second link member 107 are slidably received inside the grooves.

The urging part 134 of the switch 110 comes into contact with the center of the back surface 112 of the key top 104. In the embodiment, a contact part 174 is formed on the back surface 112 of the key top 104, at a position where the back surface 112 of the key top 104 and the apex 138 of the urging part 134 contact. The contact part 174 has such a shape or is made of such a material that obstructs the urging part 134 from sliding on the back surface 112 when the contact part 174 comes into contact with the apex 138 of the urging part 134.

The wires 114 includes a first wire 175 disposed on the front side (i.e., the downside of FIG. 7A) of the key top 104, and a second wire 176 disposed on the rear side (i.e., the upper side of FIG. 7A) of the key top 104.

The first wire 175 includes a first arm 178 extending in the long-side direction of the key top 104, a right end 180 extending from the right end of the arm 178 to the rearward of the key top 104, and a right claw 182 extending from the rear end of the right end 180 in the left direction.

Further, the first wire 175 includes a left end 184 extending from the left end of the arm 178 to the rearward of the key top 104, and a left claw 186 extending from the rear end of the left end 184 to the right direction. The first wire 175 is formed by bending a rod made of a metal. In the embodiment, the right claw 182 is formed to be shorter than the left claw 186.

The second wire 176 has the same configuration as the first wire 175, and is disposed to be point symmetry to the first wire 175 about the center of the key top 104. The second wire 176 has a second arm 188 extending in the long-side direction of the back surface 112 of the key top 104, a right end 190 extending from the right end of the arm 188 forward of the key top 104, and a right claw 192 extending from the front end of the right end 190 in the left direction.

Further, the second wire 176 includes a left end 194 extending from the left end of the arm 188 forward of the key top 104, and a left claw 196 extending from the front end of the left end 194 in the right direction. In the embodiment, the right claw 192 is formed to be longer than the left claw 196. The second wire 176 is formed by bending a rod made of a metal.

The arm 178 of the first wire 175 is supported by the claws 171 formed on the back surface 112 of the key top 104 so as to be disposed between the link 106 (107) and the front end (first short-side end) of the key top 104. Further, the right claw 182 of the first wire 175 is supported by the first wire receiving part 118 of the support plate 102, and the left claw 186 is supported by the second wire receiving part 120. According to the configuration, the first wire 175 is supported on the back surface 112 of the key top 104 and the support plate 102 in such a manner as to be pivotally movable around the axis of the arm 178.

On the other hand, the arm 188 of the second wire 176 is supported by the claws 170 formed on the back surface 112 of the key top 104 between the link 106 (107) and the rear end (second short-side end) of the key top 104. Further, the right claw 192 is supported by the first wire receiving part 118 of the support plate 102, and the left claw 196 is supported by the second wire receiving part 120. According to the configuration, the second wire 176 is supported on the back surface 112 of the key top 104 and the support plate 102 in such a manner as to be pivotally movable around the axis of the arm 188.

Next, an assembly of the support plate 102, the switch 110, the links 106 and 107 and the frames 108 and 109 is described referring to FIG. 3 to FIG. 8.

Figure 8:
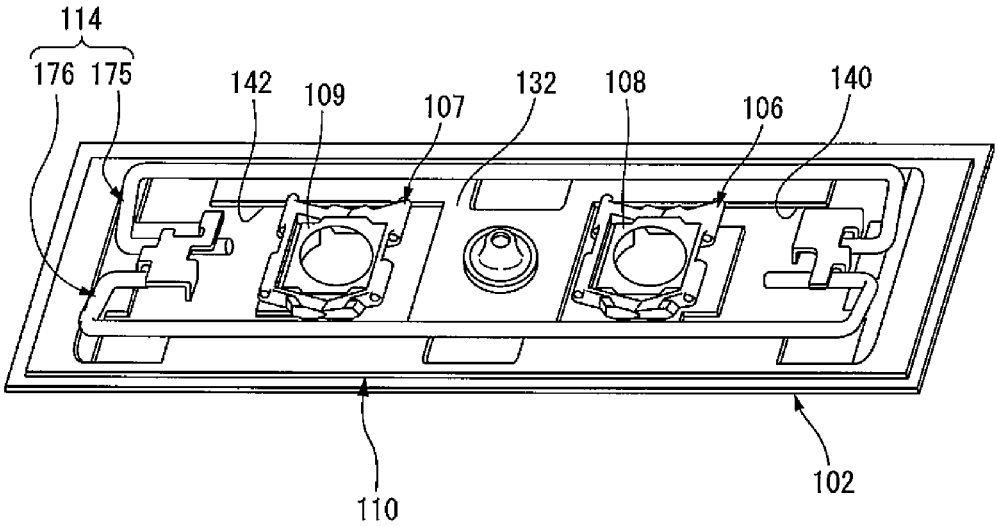
FIG. 8 is an assembly diagram of the support plate, the switch, the link, the wires and the frame illustrated in FIG. 2.

FIG. 8 is a perspective view of an assembly of the support plate 102, the switch 110, the links 106 and 107 and the frames 108 and 109, as overviewed from the rear upper side.

The sheet 132 of the switch 110 is placed on the base 116 of the support plate 102. The first link 106 is disposed at a position corresponding to the punched part 140 formed in the switch 110, and the first frame 108 is set from above the first link 106. Concurrently, the pins 154 of the first link 106 are fitted into the four holes 164 formed in the lower end of the first frame 108, and the four legs 160 of the first frame 108 are inserted and fixed in the through holes 122 formed in the support plate 102.

On the other hand, the four pins 156 formed on the first link 106 are slidably inserted in the grooves formed in the guides 172 of the key top 104, respectively. In this way, the first link 106 is mounted on the support plate 102 and the back surface 112 of the key top 104.

Likewise, the second link 107 is disposed at a position corresponding to the punched part 142 formed in the switch 110, and the second frame 109 is set from above the second link 107. Concurrently, the pins 154 of the second link 107 are fitted into the four holes 164 formed in the lower end of the second frame 109, and the four legs 160 of the second frame 109 are inserted and fixed in the through holes 123 formed in the support plate 102.

On the other hand, the four pins 156 formed on the second link 107 are slidably inserted in the grooves formed in the guides 173 of the key top 104. In this way, the second link 107 is mounted on the support plate 102 and the back surface 112 of the key top 104.

As described above, the arm 178 of the first wire 175 is supported by the claws 171 formed on the back surface 112 of the key top 104. On the other hand, the right claw 182 of the first wire 175 is inserted in the cutaway 124 formed in the first wire receiving part 118 of the support plate 102. Further, the left claw 186 of the first wire 175 is inserted in the cutaway 128 formed in the second wire receiving part 120 of the support plate 102.

Likewise, the arm 188 of the second wire 176 is supported by the claws 170 formed on the back surface 112 of the key top 104. On the other hand, the right claw 192 of the second wire 176 is inserted in the cutaway 126 formed in the first wire receiving part 118 of the support plate 102.

Further, the left claw 196 of the second wire 176 is inserted in the cutaway 130 formed in the second wire receiving part 120 of the support plate 102. In this way, the wires 114 constituted of the first wire 175 and the second wire 176 is mounted on the support plate 102 and the back surface 112 of the key top 104.

Figure 9:
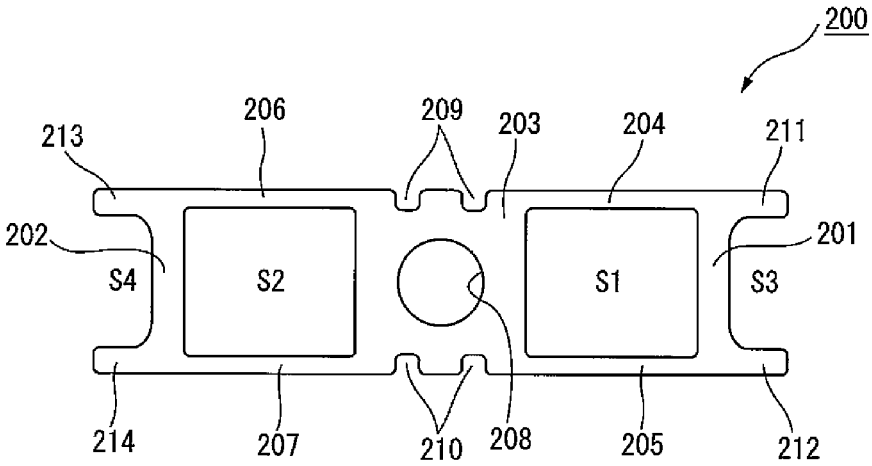
FIG. 9 is a bottom plan view of a reinforcement plate illustrated in FIG. 2.
Figure 10A:
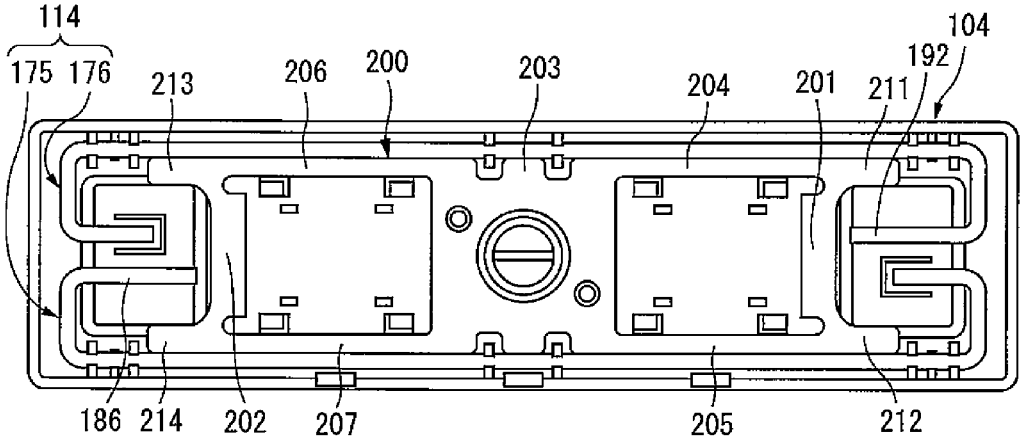
FIGS. 10A and 10B are assembly diagrams of the key top, the wires and the reinforcement plate illustrated in FIG. 2.
Figure 10B:
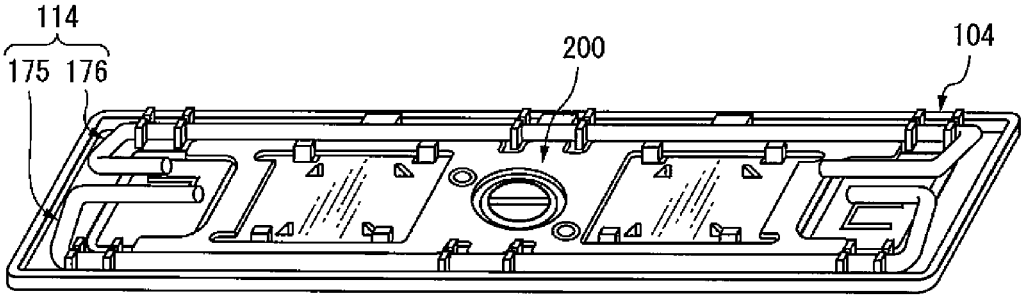

Next, the reinforcement plate 200 according to the embodiment is described referring to FIG. 9, 10A and 10B. FIG. 10A is a bottom plan view of an assembly of the key top 104, the wires 114, and the reinforcement plate 200 as viewed from below, and FIG. 10B is a perspective view of the assembly of the key top 104, the wires 114, and the reinforcement plate 200 as viewed from the lower front side.

The reinforcement plate 200 is a flat plate member, and is made of a metal such as iron. Preferably, the reinforcement plate 200 has higher rigidity than the key top 104. The reinforcement plate 200 is fixedly mounted on the back surface 112 in such a manner as to come into plane-contact with the back surface 112 of the key top 104.

The reinforcement plate 200 includes a first short-side part 201 and a second short-side part 202 extending in the short-side direction of the key top 104 between the arm 178 of the first wire 175 and the arm 188 of the second wire 176, and an plate part 203 disposed between the first short-side part 201 and the second short-side part 202.

Further, the reinforcement plate 200 includes a first long-side part 204 and a second long-side part 205 extending in the long-side direction in such a manner as to connect the first short-side part 201 with the plate part 203, and a third long-side part 206 and a fourth long-side part 207 extending in the long-side direction in such a manner as to connect the second short-side part 202 with the plate part 203.

The first short-side part 201 is disposed between the first link 106 and the right end of the key top 104 when the key switch 100 is assembled. More specifically, the first short-side part 201 linearly extends in the short-side direction of the key top 104 between the arm 178 and the arm 188 in a region between the connection part 147 (not illustrated in FIGS. 9, 10A and 10B) located on the right end of the first link 106 and the left end of the right claw 192.

Likewise, the second short-side part 202 is disposed between the second link 107 (not illustrated in FIGS. 9, 10A and 10B) and the left end of the key top 104 when the switch 100 is assembled. More specifically, the second short-side part 202 linearly extends in the short-side direction of the key top 104 between the arm 178 and the arm 188 in a region between the connection part 147 (not illustrated in FIGS. 9, 10A and 10B) located on the left end of the second link 107 and the right end of the left claw 186.

The plate part 203 is located at the center of the reinforcement plate 200 and is disposed in such a manner as to surround the urging part 134 of the switch 110 that comes into contact with the back surface 112. In the embodiment, the plate part 203 is a substantially rectangular member, and includes a center hole 208, two cutaways 209 formed in one end (the upper end of FIG. 9), and two cutaways 210 formed in the other end (the lower end of FIG. 9). The center hole 208 is formed at a position corresponding to the urging part 134 of the switch 110, and is configured to allow the urging part 134 to come into contact with the back surface 112 of the key top 104.

The cutaways 209 are formed at the positions corresponding to the two claws 170 formed in the center region of the key top 104, out of the claws 170 formed on the back surface 112 of the key top 104. Likewise, the cutaways 210 are formed at the positions corresponding to the two claws 171 formed in the center region of the key top 104, out of the claws 171 formed on the back surface 112 of the key top 104.

The first long-side part 204 linearly extends in the long-side direction from the rear end (the upper end of FIG. 9) of the first short-side part 201 to the right rear end of the plate part 203. On the other hand, the second long-side part 205 linearly extends in the long-side direction from the front end (the lower end of FIG. 9) of the first short-side part 201 to the right front end of the plate part 203.

The first short-side part 201, the first long-side part 204, the second long-side part 205 and the right marginal part of the plate part 203 define a square punched portion S1. The first link 106 is disposed at a position corresponding to the punched portion S1.

The third long-side part 206 linearly extends in the long-side direction from the rear end of the second short-side part 202 to the left rear end of the plate part 203. On the other hand, the fourth long-side part 207 linearly extends in the long-side direction from the front end of the second short-side part 202 to the left front end of the plate part 203.

The second short-side part 202, the third long-side part 206, the fourth long-side part 207 and the left marginal part of the plate part 203 define a square punched portion S2. The second link 107 is disposed at a position corresponding to the punched portion S2.

The reinforcement plate 200 includes a fifth long-side part 211 extending from the rear end of the first short-side plate part 201 in the right direction, and a sixth long-side part 212 extending from the front end of the first short-side part 201 in the right direction. The reinforcement plate 200 further includes a seventh long-side part 213 extending from the rear end of the second short-side part 202 in the left direction, and an eighth long-side part 214 extending from the front end of the second short-side part 202 in the left direction.

The first short-side part 201, the fifth long-side part 211 and the sixth long-side part 212 define a punched portion S3. The first wire receiving part 118 of the support plate 102 is disposed at a position corresponding to the punched portion S3.

On the other hand, the second short-side part 202, the seventh long-side part 213 and the eighth long-side part 214 define a punched portion S4. The second wire receiving part 120 of the support plate 102 is disposed at a position corresponding to the punched portion S4.

Figure 11:
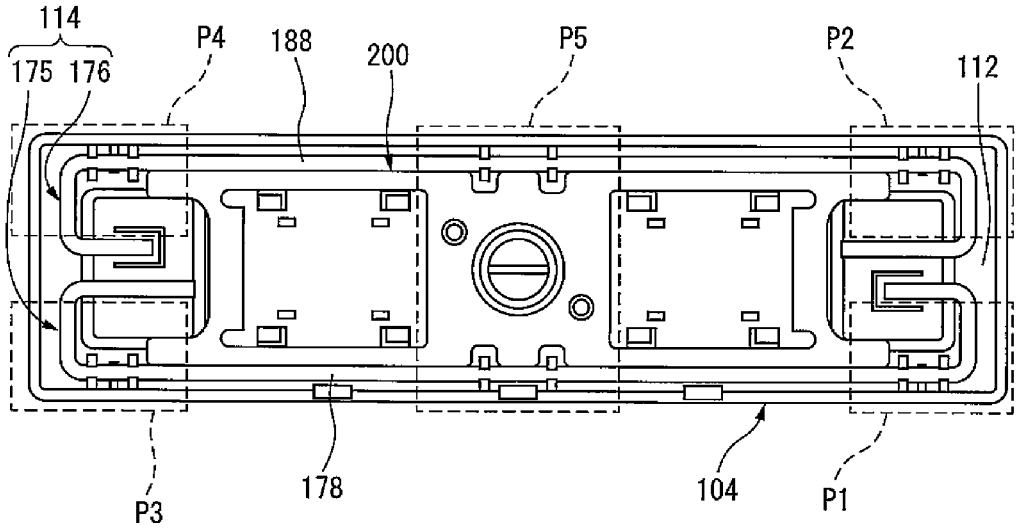
FIG. 11 is a diagram illustrating a bottom plan view of the key top with the reinforcement plate.

The key switch 100 according to the embodiment is provided with the reinforcement plate 200, and therefore, it is possible to enhance the rigidity of the key top 104. This function is described in the following referring to FIG. 11.

As described above, the first wire 175 and the second wire 176 are mounted on the back surface 112 of the key top 104. The arm 178 of the first wire 175 and the arm 188 of the second wire 176 extend in the long-side direction of the back surface 112 of the key top 104. The arms 178 and 188 function to enhance the rigidity of the key top 104 in the long-side direction.

In the embodiment, in addition to the arms 178 and 188, the reinforcement plate 200 including the first short-side part 201, the second short-side part 202 and the plate part 203 extending between the arm 178 and the arm 188 is fixedly mounted on the back surface 112 in such a manner that the reinforcement plate 200 comes into plane-contact with the back surface 112 of the key top 104. According to the configuration, it is possible to enhance the rigidity of the key top 104 in the short-side direction.

Further, it is also possible to enhance the rigidity of the key top 104 in the long-side direction by the long-side parts 204, 205, 206, 207, 211, 212, 213 and 214 of the reinforcement plate 200 together with the arms 178 and 188. Furthermore, it is possible to enhance the rigidity of the key top 104 in a region around the contact section by the plate part 203 disposed in such a manner as to surround the contact section between the key top 104 and the urging part 134 of the switch 110.

As described above, the reinforcement plate 200 according to the embodiment enhances the rigidity of the key top 104 both in the long-side direction and the short-side direction of the key top 104, and in a region around portion of the key top 104 where the urging part 134 contacts with the key top 104.

Accordingly, even when the user presses one of four corner regions P1 to P4 of the key top 104 in stroking a key, the reinforcement plate 200 suppresses deformation of the key top 104 in the short-side direction. Further, a combination of the reinforcement plate 200 and the arms 178 and 188 suppress deformation of the key top 104 in the long-side direction.

Further, even when the user presses one of the four corner regions P1 to P4 of the key top 104 and a relatively large urging force is applied to the back surface 112 of the key top 104 via the urging part 134, deformation of the key top 104 in a region around the contact section can be prevented. Therefore, an erroneous operation resulting from deformation of the key top 104 is prevented.

Further, in the embodiment, the first short-side part 201, the plate part 203 and the second short-side part 202 are integrally connected by the first long-side part 204, the second long-side part 205, the third long-side part 206 and the fourth long-side part 207. According to the configuration, it is possible to uniformly reinforce the key top 104 over a wide area, and to simplify the operation of forming and mounting the reinforcement plate 200.

Figure 12A:
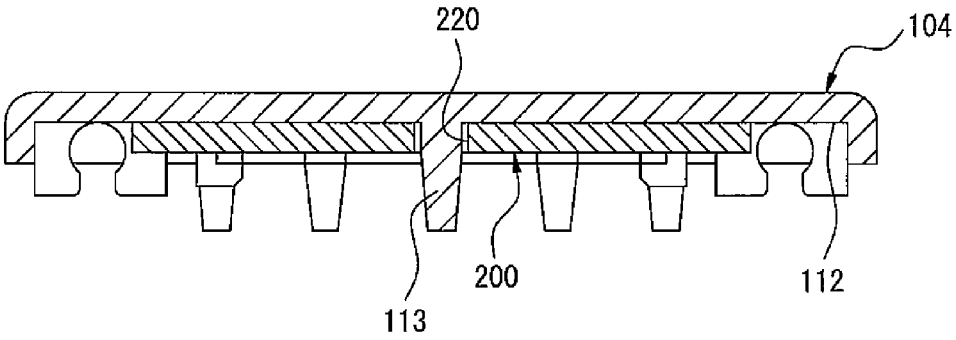
FIGS. 12A and 12B are diagrams for describing an example of a structure for mounting the reinforcement plate on the key top.
Figure 12B:
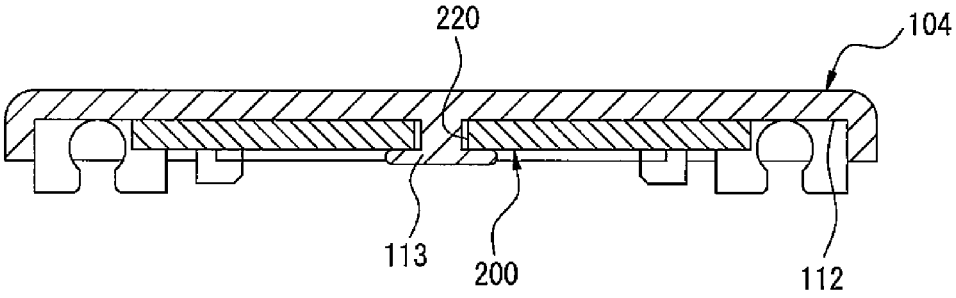

Next, a mounting of the reinforcement plate 200 according to an embodiment of the invention is described referring to FIGS. 12A and 12B. FIG. 12A illustrates a state before the reinforcement plate 200 is fixed on the back surface 112 of the key top 104, and FIG. 12B illustrates a state after the reinforcement plate 200 is fixed on the back surface 112 of the key top 104.

In the embodiment, a protrusion 113 downwardly protruding is formed on the back surface 112 of the key top 104. On the other hand, the reinforcement plate 200 includes a through hole 220 at a position corresponding to the protrusion 113 with such a diameter as to be able to receive the protrusion part 113. As illustrated in FIG. 12A, the reinforcement plate 200 is disposed on the back surface 112 of the key top 104 in such a manner that the protrusion part 113 passes through the through hole 220.

In fixing the reinforcement plate 200 on the back surface 112 of the key top 104, a distal end of the protrusion part 113 is pressed and deformed from the state illustrated in FIG. 12A to the state illustrated in FIG. 12B. As a result, the reinforcement plate 200 is locked by the deformed protrusion part 113 to fix the reinforcement plate 200 on the back surface 112 of the key top 104. In the mounting structure of the reinforcement plate 200 according to the embodiment, the reinforcement plate 200 is fixed on the back surface 112 of the key top 104 by a so-called caulking.

Figure 13:
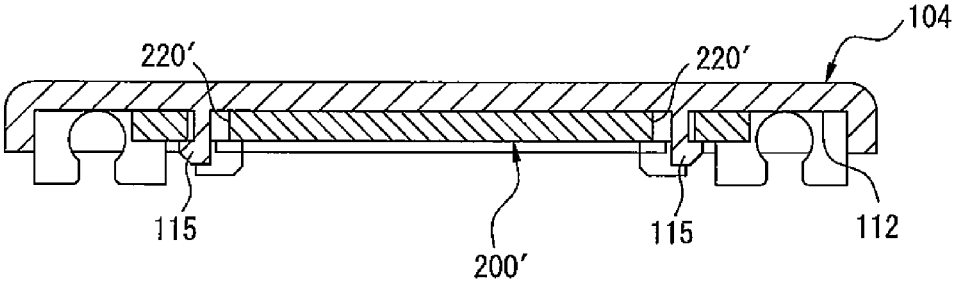
FIG. 13 is a diagram for describing another example of the structure for mounting the reinforcement plate on the key top.

Next, a mounting structure of the reinforcement plate 200' according to another embodiment of the invention is described referring to FIG. 13. In the embodiment, clasp-shaped hooks 115 protruding downward are formed on the back surface 112 of the key top 104.

The reinforcement plate 200' includes through holes 220' each having such a size as to receive the hooks 115 at positions corresponding to the hooks 115. The reinforcement plate 200' is mounted on the back surface 112 of the key top 104 by inserting the hooks 115 into the through holes 220' and by engaging the hooks 115 with the edges of the through holes 220'.

Figure 14:
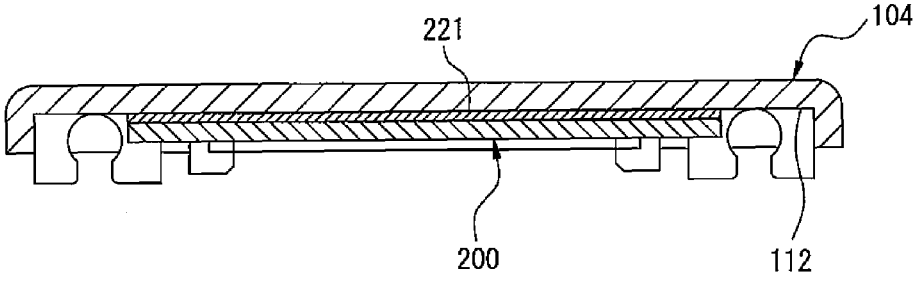
FIG. 14 is a diagram for describing yet another example of the structure for mounting the reinforcement plate on the key top.

Next, a mounting structure of the reinforcement plate 200 according to still another embodiment of the invention is described referring to FIG. 14. In the embodiment, the reinforcement plate 200 is adhesively mounted on the back surface 112 of the key top 104 with an adhesive layer 221. The adhesive layer 221 may be coated on the entirety of the upper surface of the reinforcement plate 200, or may be coated on a portion of the upper surface of the reinforcement plate 200.

Figure 15:
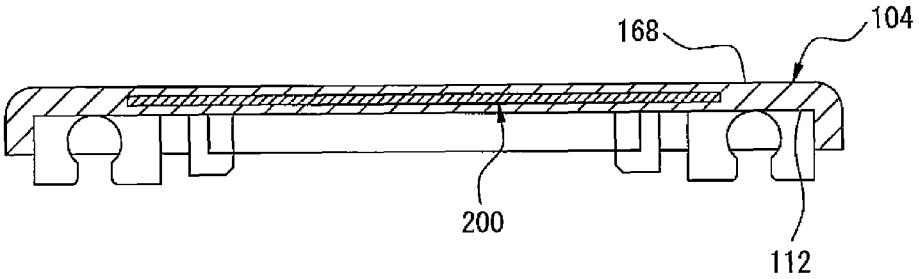
FIG. 15 is a diagram for describing still another example of the structure for mounting the reinforcement plate on the key top.

Next, a mounting structure of the reinforcement plate 200 according to still another embodiment of the invention is described referring to FIG. 15. In the embodiment, the reinforcement plate 200 is fixed on the key top 104 by insert molding. The reinforcement plate 200 is embedded inside the key top 104 in such a manner that the reinforcement plate 200 is disposed between the operation surface 168 and the back surface 112.

As described above, even when the reinforcement plate 200 is embedded in the key top 104 by insert molding, rigidity of the key top 104 in the long-side direction and the short-side direction can be enhanced.

Figure 16:
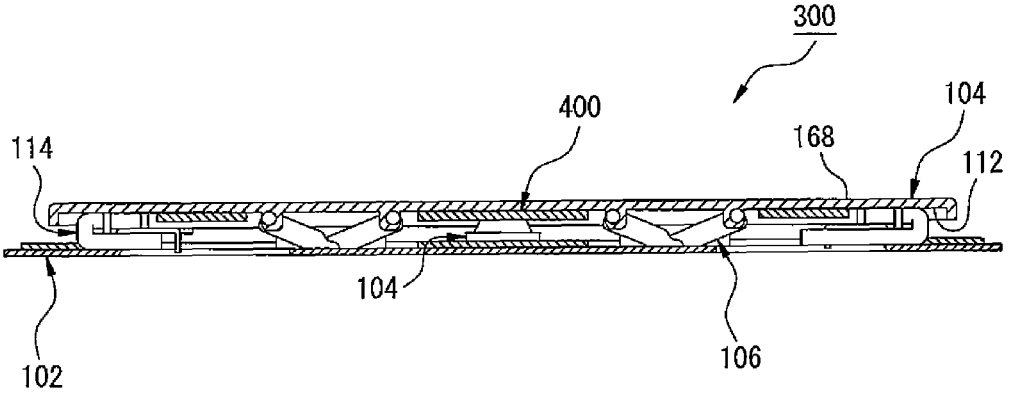
FIG. 16 is a side sectional view of a key switch according to another embodiment of the invention.
Figure 17:
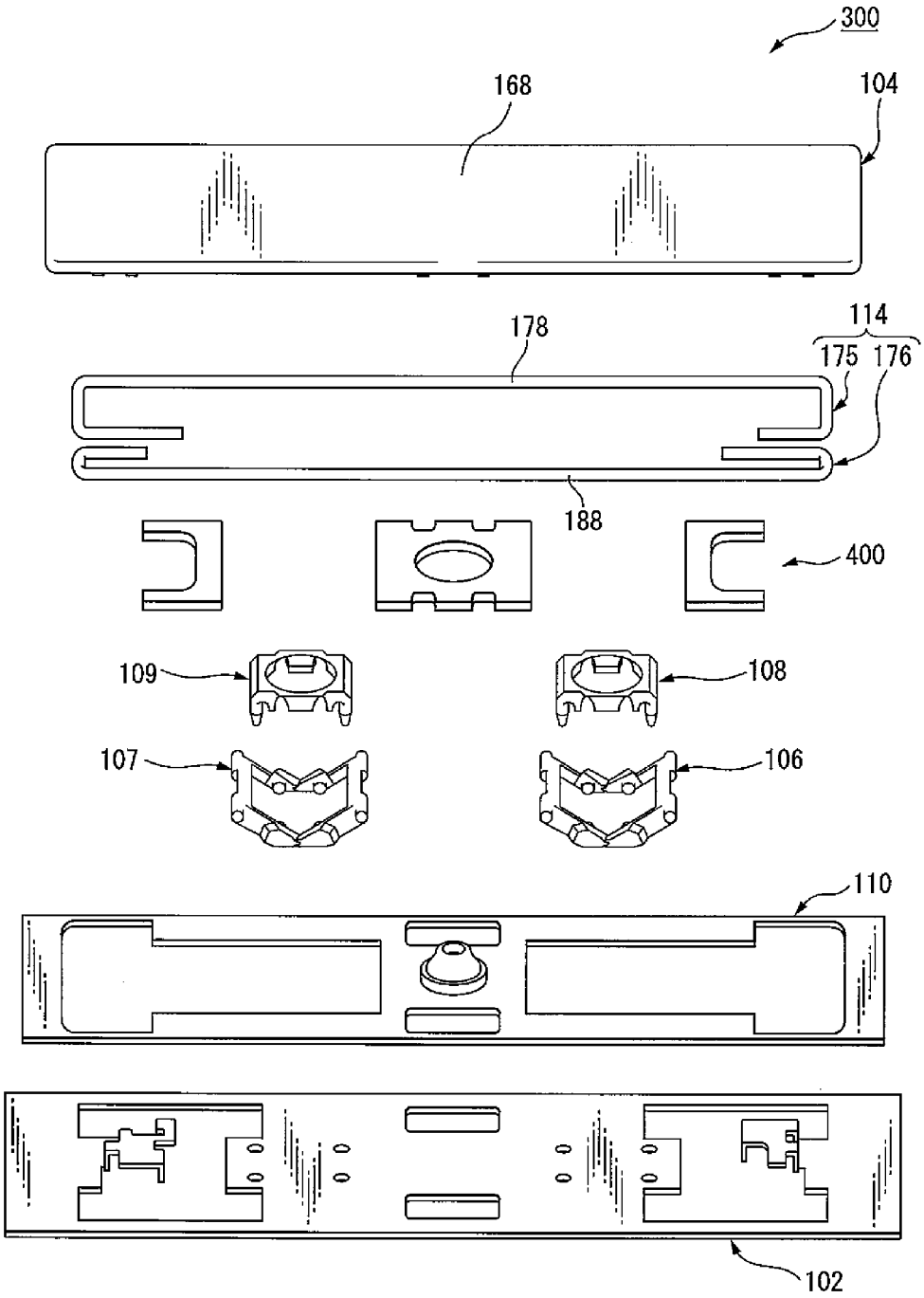
FIG. 17 is an exploded perspective view of the key switch illustrated in FIG. 16.
Figure 18:
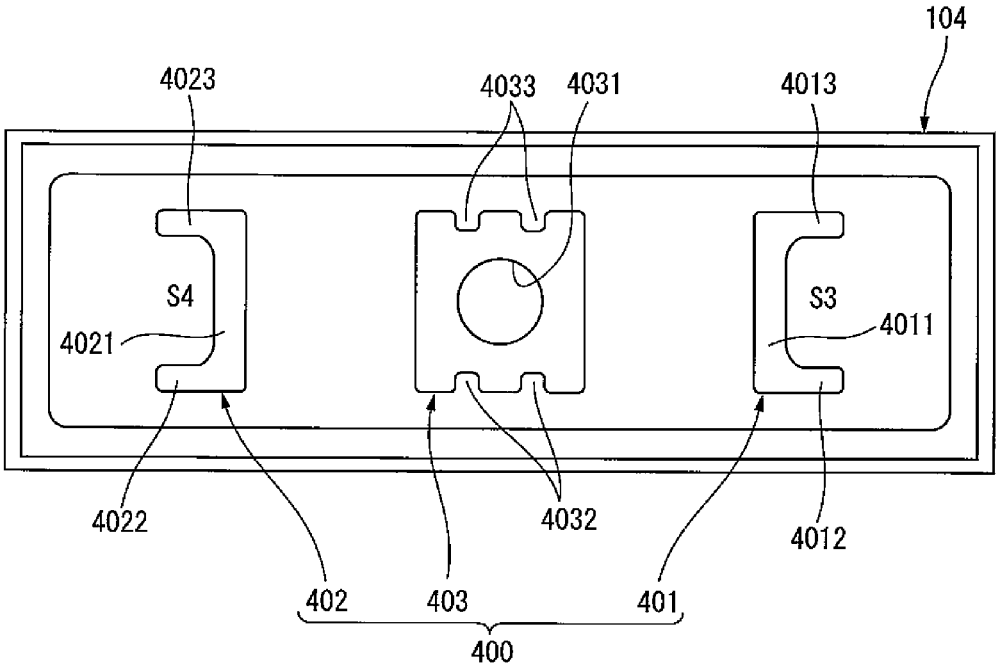
FIG. 18 is a bottom plan view of the reinforcement plate illustrated in FIG. 17.

Next, a key switch 300 according to another embodiment of the invention is described referring to FIG. 16 to FIG. 18. Substantially the same members as those in the foregoing embodiment are indicated with the same reference marks, and the detailed description is omitted.

The key switch 300 is provided with a support plate 102, a key top 104, a first link 106, a second link 107, a first frame 108, a second frame 109, a switch 110, wires 114 and reinforcement plates 400 mounted on a back surface 112 of a key top 104.

As illustrated in FIG. 18, the reinforcement plates 400 according to the embodiment includes a first reinforcement plate 401, a second reinforcement plate 402 and a third reinforcement plate 403. The first reinforcement plate 401 is disposed in the right region of the back surface 112 of the key top 104, and includes a short-side part 4011 extending in the short-side direction of the key top 104 between an arm 178 of a first wire 175 and an arm 188 of a second wire 176. The short-side part 4011 is disposed between the first link 106 and the right end of the key top 104.

Further, the first reinforcement plate 401 includes a first long-side part 4012 extending from the front end (the lower end of FIG. 18) of the short-side part 4011 in the right direction, and a second long-side part 4013 extending from the rear end (the upper end of FIG. 18) of the short-side part 4011 in the right direction.

The short-side part 4011, the first long-side part 4012 and the second long-side part 4013 define a punched portion S3. A first wire receiving part 118 of the support plate 102 is disposed at a position corresponding to the punched portion S3.

On the other hand, the second reinforcement plate 402 is disposed in the left region of the back surface 112 of the key top 104, and includes a short-side part 4021 extending along the short-side direction of the key top 104 between the arm 178 of the first wire 175 and the arm 188 of the second wire 176. The short-side part 4021 is disposed between the second link 107 and the left end of the key top 104 in the long-side direction.

Further, the second reinforcement plate 402 includes a first long-side part 4022 extending from the front end of the short-side part 4021 in the left direction, and a second long-side part 4023 extending from the rear end (the upper end of FIG. 18) of the short-side part 4021 in the left direction.

The short-side part 4021, the first long-side part 4022 and the second long-side part 4023 define a punched portion S4. A second wire receiving part 120 of the support plate 102 is disposed at a position corresponding to the punched portion S4.

The third reinforcement plate 403 is an annular reinforcement plate. The third reinforcement plate 403 is disposed at the center part of the key top 104 in such a manner as to surround a contact section between the back surface 112 of the key top 104 and an urging part 134 of a switch 110.

In the embodiment, the third reinforcement plate 403 has an outer configuration of a substantially rectangular shape, and includes a center hole 4031, two cutaways 4032 formed in the front end of the third reinforcement plate 403, and two cutaways 4033 formed in the rear end of the third reinforcement plate 403. The center hole 4031 is formed at a position corresponding to the urging part 134 of the switch 110 to enable the urging part 134 to come into contact with the back surface 112 of the key top 104.

The cutaways 4032 are formed at positions corresponding to two claws 170 formed in the center region of the key top 104, out of the claws 170 formed on the rear side of the back surface 112 of the key top 104. Likewise, the cutaways 4033 are formed at positions corresponding to two claws 171 formed in the center region of the key top 104, out of the claws 171 formed on the front side of the back surface 112 of the key top 104.

In the reinforcement plate 400 according to the embodiment, the first reinforcement plate 401, the second reinforcement plate 402 and the third reinforcement plate 403 are separated from each other, and function to enhance the rigidity of the key top 104 in each of the regions where the first reinforcement plate 401, the second reinforcement plate 402 and the third reinforcement plate 403 are mounted.

Specifically, the short-side part 4011 of the first reinforcement plate 401 can enhance the rigidity of the right region of the key top 104 in the short-side direction. Further, the first long-side part 4012 and the second long-side part 4013 of the first reinforcement plate 401 and the arms 178 and 188 extending in the long-side direction can enhance the rigidity of the right region of the key top 104 in the long-side direction.

Further, the short-side part 4021 of the second reinforcement plate 402 can enhance the rigidity of the left region of the key top 104 in the short-side direction. Additionally, the first long-side part 4022 and the second long-side part 4023 of the second reinforcement plate 402 and the arms 178 and 188 extending in the long-side direction can enhance the rigidity of the left region of the key top 104 in the long-side direction.

Further, the third reinforcement plate 403 can enhance the rigidity of a region around the urging part 134. As described above, the reinforcement plate 400 according to the embodiment can also enhance the rigidity of the key top 104 both in the long-side direction and the short-side direction together with the arms 178 and 188. Thus, it is possible to prevent an erroneous operation resulting from deformation of the key top 104.

In the foregoing embodiments, a short-side part is disposed between a link and a long-side part of a key top, but the invention is not limited to the configuration. Alternatively, the short-side part may be disposed between an urging part of a switch and a link, or may be disposed at any position, as far as the short-side part does not interfere with the other members.

Further, in the foregoing embodiments, a long-side part is disposed at both ends of a short-side part in the front-rear direction, but alternatively, the long-side part may be disposed at a position near the center of a short-side part, or may be disposed at any position, as far as the long-side part does not interfere with the other members.

Furthermore, in the foregoing embodiments, an plate part has a substantially rectangular shape including a center hole, but alternatively, as far as the plate part is configured to surround a contact section of a key top with an urging part of a switch, the annular plate may have any shape such as a polygonal shape, a circular shape, or an elliptical shape. Further, the plate part may be formed in such a manner as to surround the entire periphery of a contact section or surround a part of the periphery of an urging part.

In another aspect of the invention, the invention relates to a keyboard. The keyboard comprises a support plate and a plurality of key switches aligned in a plural number and loaded thereon. Each of the key switches may correspond to one of the above key switches 100 and 300, which includes a key top disposed on the support plate; a link configured to link the key top with the support plate; a switch; and a reinforcement plate mounted on the key top, for reinforcement of the key top.

The key switch of the keyboard may further comprise a first arm disposed on a back surface of the key top between the link and a first short-side end of the key top, and extending in a long-side direction of the key top; and a second arm disposed on the back surface of the key top between the link and a second short-side end of the key top, and extending in the long-side direction of the key top. The reinforcement plate comprises a short-side part extending in the short-side direction of the key top between the first arm and the second arm.

The reinforcement plate may include a plate part configured in such a manner as to surround the urging part that comes in contact with the key top plural plates.

The invention has been described by way of the embodiments of the invention. The foregoing embodiments, however, do not limit the invention defined in the claims. Further, all the combinations of the features described in the embodiments may not be essential as solution means of the invention. Further, it is obvious for those skilled in the art that a variety of modifications or improvements to the embodiments can be added. In addition it is obvious that such modifications or improvements are also included in the technical scope of the invention, as defined in the claims of the invention.

The invention claimed is:

1. A key switch, comprising:
a support plate;
a key top disposed above the support plate;
a link configured to link the support plate with the key top;
a switch provided with an urging part configured to urge the key top upward; and
a reinforcement plate substantially reinforcing the key top, mounted on the key top and configured in such a manner as to surround a contact section where the key top and the urging part contact each other.

2. A key switch according to claim 1, wherein an upper surface of the reinforcement plate comes into plane-contact with a surface of the key top.

3. A keyboard comprising;
a support plate; and
key switches, at least one of the key switches including:
a key top disposed on the support plate;
a link configured to link the key top with the support plate;
a switch;
a first arm disposed on a back surface of the key top and extending in a long-side direction of the key top;
a second arm disposed on the back surface of the key top and extending in the long-side direction of the key top; and
a reinforcement plate mounted on the key top and including a short-side part extending in a short-side direction of the key top between the first arm and the second arm.

4. The keyboard according to claim 3, wherein
the reinforcement plate includes a plate part configured in such a manner as to surround the urging part that comes in contact with the key top.

5. A key switch, comprising:
a support plate;
a key top disposed on the support plate;
a link configured to link the key top with the support plate;
a switch;
a first arm disposed on a back surface of the key top between the link and a first short-side end of the key top, and extending in a long-side direction of the key top;

a second arm disposed on the back surface of the key top between the link and a second short-side end of the key top, and extending in the long-side direction of the key top; and a reinforcement plate mounted on the key top, wherein the reinforcement plate comprises a short-side part extending in the short-side direction of the key top between the first arm and the second arm.

6. The key switch according to claim 5, wherein the short-side part is disposed between the link and a long-side end of the key top.

7. The key switch according to claim 5, wherein the reinforcement plate further comprises a long-side part extending in the long-side direction of the key top.

8. The key switch according to claim 5, wherein the link includes:

a first link disposed between the urging part and a first long-side end of the key top; and a second link disposed between the urging part and a second long-side end of the key top.

9. The key switch according to claim 5, wherein the switch includes an urging part configured to urge the key top upward, and wherein the reinforcement plate further comprises a plate part disposed in such a manner as to surround a contact section where the urging part comes into contact with the key top.

10. The key switch according to claim 9, wherein the plate part comprises a through hole at a position corresponding to the contact section.

* * * * *